United States Patent [19]

Matsushita

[11] Patent Number: 4,710,043

[45] Date of Patent: Dec. 1, 1987

[54] IMPACT PRINTER WITH VARIABLE DELAY FOR PRINT CYCLE BASED ON DIFFERENT PRINT-HAMMER ENERGY LEVELS

[75] Inventor: Tsuyoshi Matsushita, Shizuoka, Japan

[73] Assignee: Tokyo Electric Co., Ltd., Tokyo, Japan

[21] Appl. No.: 849,060

[22] Filed: Apr. 7, 1986

[30] Foreign Application Priority Data

Apr. 18, 1985 [JP] Japan ..... 60-83089

[51] Int. Cl.[4] ..... B41J 1/30

[52] U.S. Cl. ..... 400/144.2; 400/157.3; 400/166; 400/322

[58] Field of Search ..... 400/144.2, 157.3, 166, 400/50–52, 320, 322, 328

[56] References Cited

U.S. PATENT DOCUMENTS

| | | | |
|---|---|---|---|
| 4,037,208 | 7/1977 | Osterlund et al. | 364/900 |
| 4,118,129 | 10/1978 | Grundherr | 400/144.2 |
| 4,293,233 | 10/1981 | Hoffman | 400/144.2 |
| 4,493,570 | 1/1985 | Araki | 400/144.2 |

FOREIGN PATENT DOCUMENTS

| | | | |
|---|---|---|---|
| 0145961 | 6/1985 | European Pat. Off. | 400/144.2 |
| 3232142 | 5/1983 | Fed. Rep. of Germany | 400/144.2 |
| 58890 | 5/1981 | Japan | 400/157.3 |
| 169384 | 10/1982 | Japan | 400/144.2 |
| 2110853 | 6/1983 | United Kingdom | 400/144.2 |

OTHER PUBLICATIONS

*Xerox Disc. Bulletin,* by David R. Deetz, vol. 4, No. 2, Mar./Apr. 1979, pp. 157–158.

*IBM Tech. Disc. Bulletin,* vol. 28, No. 10, Mar. 1986, pp. 4386–4390.

*IBM Tech. Disc. Bulletin,* vol. 27, No. 7B, Dec. 1984, pp. 4423–4425.

*Primary Examiner*—Paul T. Sewell

*Attorney, Agent, or Firm*—Frishauf, Holtz, Goodman & Woodward

[57] ABSTRACT

A printing device comprises a carriage having a printing wheel, a printing ribbon driver and printing hammer fixed thereto, carriage driver for driving the carriage along a platen, wheel driver for setting the printing wheel to a position corresponding to an input character code, and hammer for driving the printing hammer. The printing device further comprises a memory for storing energy data corresponding to a character code representing a type formed at the top end portion of a corresponding spoke of the printing wheel as well as time data, and a control circuit for reading the energy data corresponding to the input character code as well as the time data and for supplying the energy data from the memory to the hammer driver when the printing wheel is set to a printing position designated by the input character code and preventing an operation of the wheel driver over a time period corresponding to the time data from the memory after the printing hammer has been driven by a printing energy corresponding to the energy data.

7 Claims, 8 Drawing Figures

IMPACT PRINTER WITH VARIABLE DELAY FOR PRINT CYCLE BASED ON DIFFERENT PRINT-HAMMER ENERGY LEVELS

BACKGROUND OF THE INVENTION

This invention relates to a printing device for varying a printing energy applied by a printing hammer to a type in accordance with a character to be printed.

In a printing device using a printing wheel having types at the corresponding end portions of its respective spokes, a type having a wider contact area with respect to a printing ribbon, such as a type "W", is struck by a printing hammer on a paper sheet with a great printing energy so that printing may be effected with substantially equal printing energy per unit contact area for all the types, i.e., printing may be achieved through the printing ribbon onto the paper sheet with a substantially equal ink concentration for all types. In order for the printing energy per unit contact area to be kept completely constant for all types, a complex circuit arrangement is required and because ordinary printing energy requires setting various preset values.

In order to vary the printing energy in general, it is necessary to control the turn-on time or the conduction level of a current which is supplied to a solenoid for driving the printing hammer. That is, a greater turn-on time or conduction current level is employed for a greater printing energy.

The aforementioned printing device for varying the printing energy level in accordance with the shape of the type or character has the following tasks to be solved.

FIG. 1 shows a positional relation among a printing hammer 1, types 2 formed at the top end portions of spokes on the printing wheel, printing ribbon 3, printing paper sheet 4 and platen 5. With D1, D2 and D3 representing distances of the forward end of printing hammer 1 with respect to type 2, printing ribbon 3 and platen 5, respectively, when the hammer driving solenoid is energized, printing hammer 1 is driven in a direction of an arrow in FIG. 1 to cause type 2 to be struck against platen 5 through printing ribbon 2 and printing paper sheet 4.

The characteristic curves of FIG. 2 at this time show a relation between a time and a distance of printing hammer 1 from its reference position and, as shown in FIG. 2, they greatly vary depending upon the level of a printing energy applied to printing hammer 1, for example, upon a turn-on time TH of an energization current supplied to the hammer driving solenoid. The characteristic curve A in FIG. 2 shows a printing hammer movement characteristic when the turn-on time TH of the hammer solenoid is set to a time $TH_0$ corresponding to a smaller printing energy. The characteristic curve B shows a printing hammer movement characteristic when the turn-on time of the hammer solenoid is set to a time $TH_1$ corresponding to a greater printing energy. As appreciated from a comparison between the characteristic curves A and B, since the speed of movement of printing hammer 1 is lower for a smaller energy level, a time $(t_2-t_0)$ taken from the start of the movement of the hammer at time $t_0$ to its return to an original position at time $t_2$ after the striking of the hammer against platen 5 at time $t_1$ is markedly greater than a corresponding time $(t_4-t_0)$ taken in the same way when the printing energy is at a higher level.

The time at which, subsequent to driving the printing hammer at a given printing cycle and printing one character on the paper sheet on the platen, the printing wheel starts its rotation at the next printing cycle is necessary to be set to a time equal to, or later than, the time at which the distance of the hammer 1 from its reference position becomes shorter than a distance D1. Thus, the time at which at the next printing cycle the printing wheel starts its movement is set to about the time $t_2$ at which the printing hammer 1 returns from the start of movement of the printing hammer at time $t_0$ to the original position after it has been moved along the characteristic curve A.

However, if the movement start times were all set at an equal value in spite of a difference between the curves A and B, that is, a difference in an energy with which the type is printed, there was a waste wait time $(t_2-t_4)$, presenting the problem of lowering the printing speed as a whole.

SUMMARY OF THE INVENTION

It is accordingly the object of this invention to provide a printing device which can vary a drive inhibition time for inhibiting a printing wheel from being driven at a printing cycle in accordance with types to be struck against a platen, whereby it is possible to save a possible waste wait time and thus to improve a printing speed as a whole.

This object can be achieved by a printing device comprising a printing wheel having types formed at the top end portions of it spokes, carriage having the printing wheel, a printing ribbon driver and printing hammer fixed thereto, platen, carriage driven for driving the carriage along the platen, printing wheel driver for setting the printing wheel to a printing position corresponding to an input character code, a memory for storing energy code data and time data corresponding to the character code representing the type, and control circuit for reading the energy and time data out of the memory and for driving the printing hammer with a printing energy corresponding to the energy data from the memory and then preventing the operation of the printing wheel driver or carriage driver over a time period corresponding to the time data from the memory.

According to this invention, a printing energy for use in driving the printing hammer varies in accordance with an input character code and a drive inhibition time from the driving of the printing hammer until the printing wheel starts to be driven in accordance with a next input character code also varies. Where, therefore, the printing hammer is driven with a greater printing energy a shorter drive inhibition time is set. Therefore, the printing wheel can be driven in accordance with the next character code in an earlier timing, thus improving the speed with which the printing device is driven.

DETAILED DESCRIPTION OF THE PREFERRED EMBODIMENT

Figure 1:
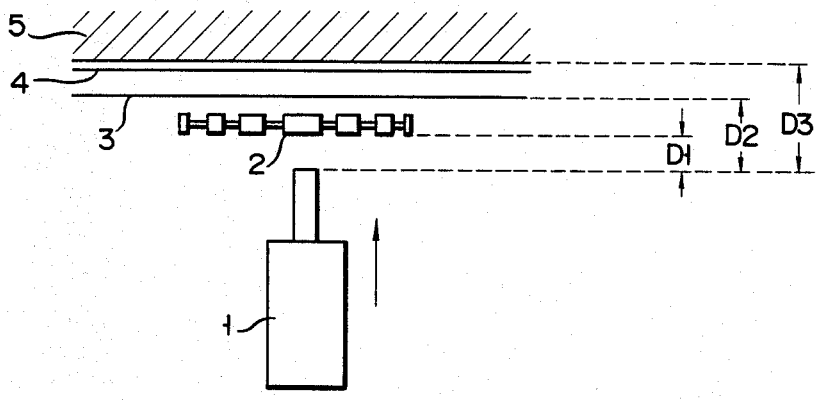
FIG. 1 (PRIOR ART)
FIG. 1 shows a relative, positional relation among a printing hammer, types and printing wheel in a conventional printing device.
Figure 3:
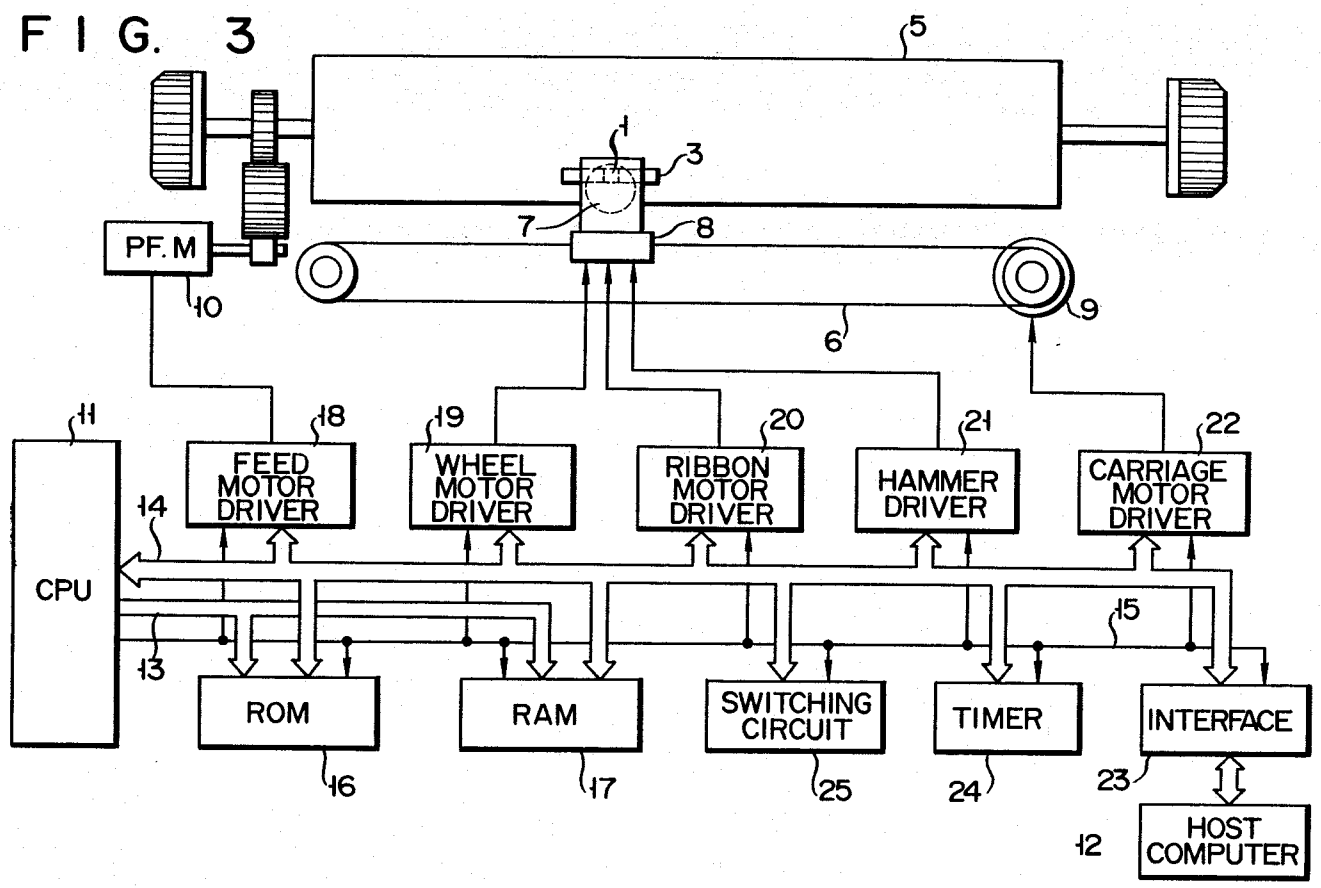
FIG. 3 is a block diagram showing a printing device according to an embodiment of this invention.

FIG. 3 is a schematic diagram showing a printing device according to the embodiment of this invention. The printing device has printing hammer 1, ribbon 3 and platen 5 in the same positional relation as shown in FIG. 1. Belt 6 is entrained along platen 5. Printing hammer 1, printing wheel 7 having a plurality of spokes each having type 2 formed at the front end portion as shown in FIG. 1, cassette containing ink ribbon 3, and carriage 8 having a hammer solenoid, printing wheel motor, ribbon feed motor, etc. for driving these component parts, are provided on belt 6. Carriage 8 is so controlled that it can be moved from left to right, or vice versa, by carriage motor 9 connected to a pulley on belt 6. Platen 5 is rotated by paper feed motor 10 through a gear mechanism. U.S. Pat. Nos. 4,037,208 or 4,118,129 discloses carriage 8 and various component parts on the carriage.

Central processing unit (CPU) 11 executes various data processings in accordance with character codes and various control signals which are input from external host computer 12. CPU 11 controls ROM 16 for storing fixed data, such as a control program, through address bus 13, data bus 14 and control line 15 and RAM 17 for temporarily storing variable data, such as data input from host computer 12. Feed motor driver 18 for paper feed motor 10, wheel motor driver 19 for the printing wheel motor, ribbon motor driver 20 for the ribbon feed motor, hammer driver 21 for conducting current to a hammer solenoid of printing hammer 1, carriage motor driver 22 for carriage motor 9, I/O interface 23 for receiving various data from host computer 12, timer 24 for counting time lapsing from the start of an operation of printing hammer 1, and switching circuit 25 including various kinds of control switches are connected to CPU 1 through data bus 14 and control line 15. Timer 24 is comprised of, for example, a timer counter and three time data registers. By comparing the contents of the timer counter with the respective contents of these time data registers a check is made as to whether or not a time lapses which is determined by time data stored in the aforementioned time data registers.

Figure 4:
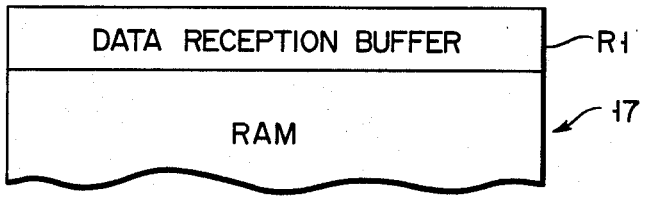
FIG. 4 shows a memory map of a RAM shown in FIG. 3.

Data reception buffer R1 for temporarily storing character codes and various instructions which are input to I/O interface 23 is formed in RAM 17 as shown in FIG. 4.

Figure 5A:
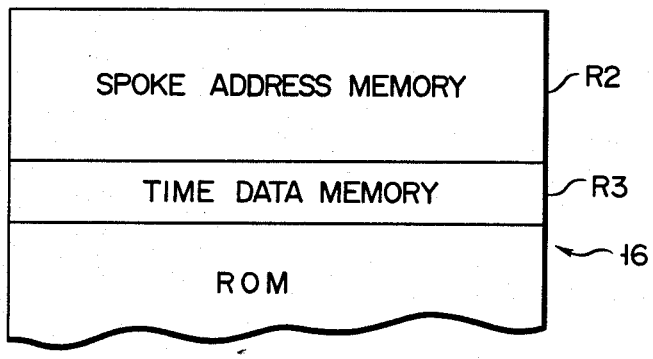
FIGS. 5A to 5C show a memory map in a RAM as shown in FIG. 3.
Figure 5B:
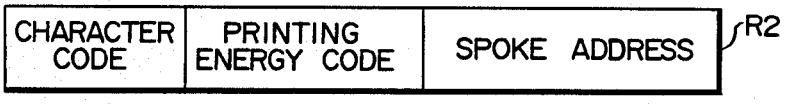

ROM 16 includes not only a memory area for storing the aforementioned control program, but also a spoke address memory R2 and time data memory R3 as shown in FIG. 5A. For each character code, such as ASCII, type 2 is formed which corresponds to the character code, and as shown in FIG. 5B, spoke address memory R3 stores, for example, a spoke address showing the rotation position of the spokes of printing wheel 7 and energy code or data showing a printing energy level corresponding to the character code. Here the energy code "0" represents a smaller printing energy level and the energy code "1" represents a greater printing energy level. The intensity of the printing energy is determined, depending upon the configuration of the types. Thus, the energy code "1" represents a greater contact area between the type and the ribbon and the energy code "0" represents a smaller contact area.

Figure 5C:
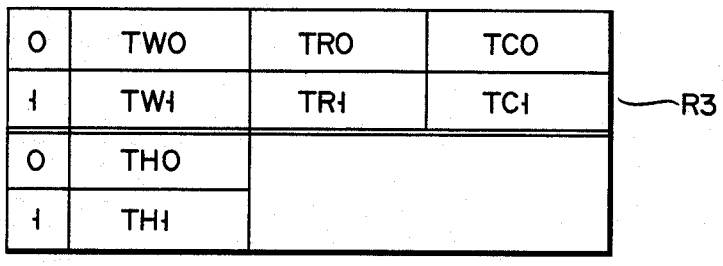

As shown in FIG. 5C, time data memory R3 stores, with respect to the respective printing energy levels of the aforementioned energy codes "0" and "1", drive inhibition times which are represented in terms of times lapsing from time $t_0$. That is, a time $TW_0$ required for printing hammer 1 to be returned to a position of type 2 on printing wheel 7, i.e., to a position corresponding to a distance D1 from a reference position after type 2 has been pushed against platen 5, time $TR_0$ required for printing hammer 1 to be returned to a position of printing ribbon 3, i.e., to a position corresponding to a distance $D_2$ from the reference position and time $TC_0$ required for printing hammer 1 to be returned to a position substantially intermediate between platen 5 and printing ribbon 3, i.e., to a position corresponding to a distance $(D2+D3)/2$ from the reference position, are stored in memory R3 with respect to the printing energy levels corresponding to the curve A in FIG. 2. Similarly, times $TW_1$, $TR_1$ and $TC_1$ required for printing hammer 1 to be returned to the aforementioned respective positions are stored in memory R3 with respect to the printing energy levels corresponding to the curve B.

Time data memory R3 stores the turn-on times $TH_0$ and $TH_1$ which are determined in accordance with the respective printing energy codes "0" and "1" so that, at a time of printing, energization current flows through the hammer solenoid on printing hammer 1 for a time defined by the turn-on time $TH_0$ to $TH_1$.

Figure 6:
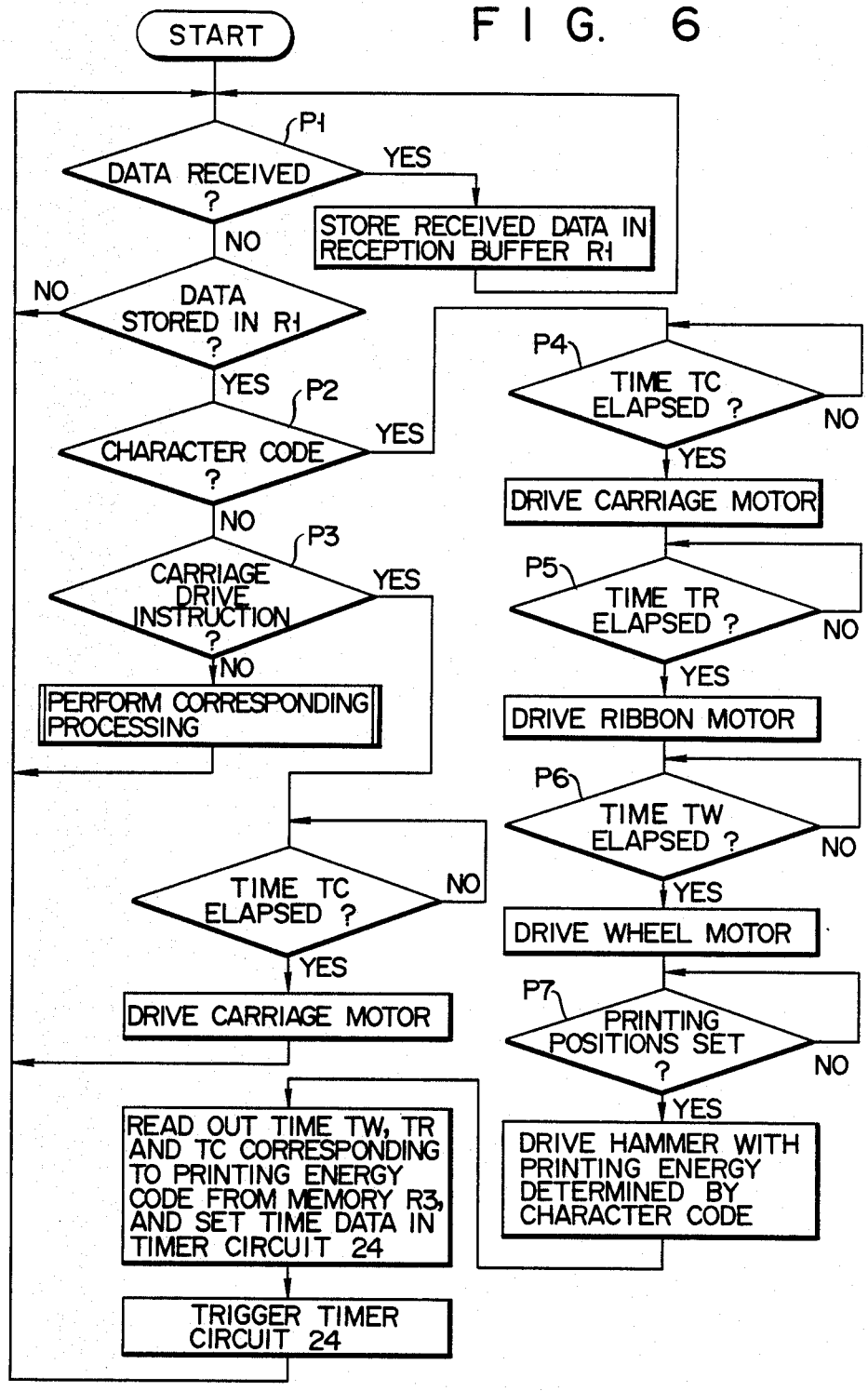
FIG. 6 is a flow chart for explaining an operation of the printing device.

With the power supply of the printing device in an ON state, CPU 11 performs, subsequent to various initial processes, a printing process in accordance with a flowchart as shown in FIG. 6. That is, at step P1, a check is made as to whether or not a character code or various control instruction data are input from host computer 12 to I/O interface 23. If the answer is YES, the input data is once stored in receiving buffer R1 in RAM 17. Then a check is made as to whether or not one or more data items are stored in receiving buffer R1. If the answer is YES, then the data item is read out to see what category it belongs to. If it is detected at step P2 that the data is not a character code, a check is made at step P3 as to whether or not there is a carriage drive instruction. If there is the carriage drive instruction, drive data is supplied to carriage motor driver 22 to start carriage motor 9 after the drive inhibition time TC for carriage 8 set in timer 24 has elapsed. Then the process goes back to step P1 so as to examine the data input of I/O interface 23.

If at step P3 data read out of receiving buffer R1 is neither the character code nor the carriage drive instruction, CPU 11 judges that the data is another function instruction for change of lines, change of pages, tab-setting, etc. and executes a process corresponding to the instruction.

If at step P2 the data read out of receiving buffer R1 is detected as being the character code, CPU 11 judges that the printing cycle of the character corresponding to the character code is started. Thus the process goes to step P4. At step P4, carriage motor 9 is started in the same way as mentioned above after the drive inhibition time TC for carriage 8 set to timer circuit 24 in the previous printing cycle has elapsed. If a start instruction of carriage motor 9 is sent to carriage motor driver 22, ribbon-feed motor is driven through ribbon motor driver 20 after the drive inhibition time TR for printing ribbon 3 set to timer 24 has elapsed. When a supply of the start instruction to ribbon motor driver 20 is completed, the printing wheel motor is started through wheel motor driver 19 after the drive inhibition time TW for printing wheel 7 set to timer 24 in the previous printing cycle has elapsed. As a result, printing wheel 7 starts its rotational movement to a spoke address position corresponding to the character code which has been read out of spoke address memory R2 in ROM 16. When a start instruction is sent to wheel motor driver 19, then carriage 8, printing ribbon 3 and printing wheel 7 are kept driven until they have moved predetermined amounts, after they have been started at step P7.

When carriage 8, printing ribbon 3 and printing wheel 7, are set at step P7 to their printing positions, a printing energy level corresponding to the character code "0" or "1" read out of spoke address memory R2 is converted to the turn-on time $TH_0$ or $TH_1$ in time data memory R3. The hammer solenoid is turned ON, over the aforementioned turn-on time $TH_0$ or $TH_1$, through hammer driver 21. As a result, printing hammer 1 is driven with a printing energy corresponding to the aforementioned turn-on time and a character corresponding to the character code is printed on printing paper sheet 4 on platen 5.

The drive inhibition times TW, TR and TC for printing wheel 7, printing ribbon 3 and carriage 8 are read out from time data memory R3 in ROM 16 in accordance with the printing energy used to print a character in a present printing cycle, and are then set in timer 24 when energization of hammer solenoid is started. That is, if the energy code of the character printed, for example, in a present printing cycle represents a small energy level "0", then drive inhibition times $TW_0$, $TR_0$ and $TC_0$ are set to timer 24. When this is done, timer 24 is started, starting the count of the respective drive inhibition times. Then the process goes back to step P1 to check whether or not there is data in I/O interface 23.

Figure 2:
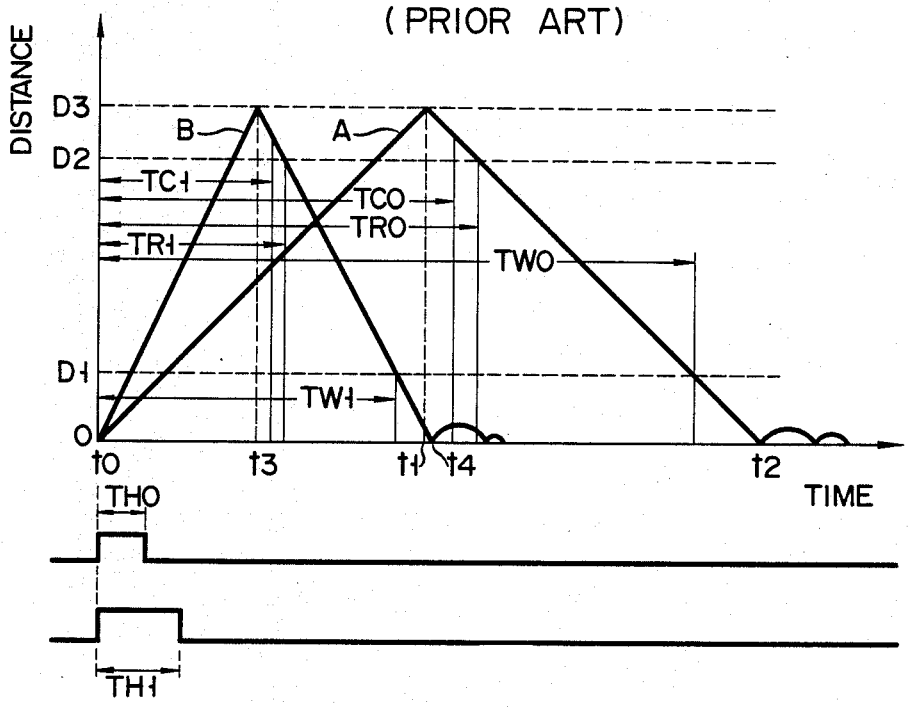
FIG. 2 (PRIOR ART)
FIG. 2 is a graph showing a relation between a movement of the printing hammer from a reference position and a time at which time data supplied to a hammer driving solenoid varies.

In FIG. 2, the drive inhibition time TW from the drive start time $t_0$ for printing hammer 1 until printing wheel 7 starts to move to a spoke address position corresponding to the next character code is set, depending upon a greater or a smaller printing energy level. Thus, when a character is printed, for example, with a greater printing energy, the next printing wheel drive start timing is set faster than with a smaller printing energy with the result that it is possible to obtain a faster printing speed as a whole. Time data memory R3 stores the drive inhibition time TW for printing wheel 7 and drive inhibition times TR and TC for printing ribbon 3 and carriage 8 which correspond to this printing energy. Each time counter 24 has counted the respective drive inhibition times TC, TR and TW, carriage 8, printing ribbon 3 and printing wheel 7 are started to move. Since, in this way, carriage 8, printing ribbon 3 and printing wheel 7 are started in a sequence determined by the length of drive inhibition times, a whole time lapsing until the next character is printed can be reduced in comparison with the case where the aforementioned component parts are all moved at a time. If, for example, the same character is printed through printing wheel 7 or a character on a spoke which is adjacent to character on a spoke now printed is printed, a carriage drive time for the next character printing is set longer than the printing wheel setting time in which case carriage 8 is started earlier than printing wheel 7 to permit a whole operation time to be reduced.

This invention is not restricted to the aforementioned embodiment. In the aforementioned embodiment the three drive inhibition times TW, TR and TC for printing wheel 7, printing ribbon 3 and carriage 8 are stored in time data memory R3 so that they are started at the completion of seqentially counting the respective drive inhibition times by means of timer 24. However, a whole printing speed can also be increased even if printing wheel 7, printing ribbon 3 and carriage 8 are simultaneously started after the lapse of the drive inhibition time TW for printing wheel 7 which is stored, as the longest inhibition time, in time data memory R3.

Furthermore, printing wheel 7 and carriage 8 can be started at the completion of counting the drive inhibition times TW and TC by means of timer 24 which are stored in time data memory R3, and the printing ribbon can be started in synchronism with the drive starting time for printing wheel 7. Since the drive time is short for printing ribbon 3, the drive inhibition time for printing ribbon 3 may be always set to the drive inhibition time $TR_0$ which is determined as in FIG. 2 in the case of a smaller printing energy.

Although in this embodiment the respective drive inhibition times TW, TR and TC have initially stored in time data memory R3 in ROM 16, these respective times may be determined by a proper program in accordance with the printing energy level.

Although in this embodiment the printing energy has been set to two levels, it may be set to three or more levels.

What is claimed is:

1. A printing device comprising:

a printing wheel having types formed at respective outer end portions of its respective spokes;

printing wheel driving means responsive to a wheel drive signal to rotate the printing wheel so that it is set to a printing position designated by an input character code;

a printing ribbon driver;

a printing hammer;

a printing hammer driving means for driving the printing hammer with a printing energy corresponding to energy data;

carriage having the printing wheel, printing ribbon driver and printing hammer fixed thereto;

a platen;

a carriage driving means for driving the carriage along the platen so that it is set to a printing position;

memory means for storing energy data and time data corresponding to the character code representing the type; and control means for reading energy data and time data corresponding to the input character code and for supplying the energy data from the memory means to the printing hammer driving means when the printing wheel is set to a printing position designated by the input character code and preventing the operation of the carriage driving means over a time period corresponding to the time data from the memory means after the printing hammer has been driven with a printing energy corresponding to the energy data.

2. A printing device according to claim 1, wherein said control means comprises timer means and control means for setting to the timer means the time data read out of the memory means in accordance with the input character code, for supplying the energy data to the printing hammer driving means to cause the printing hammer to be driven and at the same time starting the timer means, and for preventing the operation of said carriage driving means until a time corresponding to the time data set to the timer means lapses.

3. A printing device according to claim 1, wherein said control means further comprises a memory for storing energization time data, corresponding to said input character code, as energy data and said control unit supplies said energization time data read out of said memory to said printing hammer driving means and drives said printing hammer over a time period corresponding to the energization time data.

4. A printing device according to claim 1, wherein the respective time data stored in said memory means contains first and second holding time data respectively indicating a first time interval and a second time interval which is shorter than the first time interval, and said control means comprises timer means and a control unit means for setting in said timer means said first and second holding time data read out of said memory means in accordance with said input character code, for supplying said energy data to said printing hammer driving means to cause said printing hammer to be driven while at the same time starting said timer means, and for preventing the operation of said printing wheel driving means and said carriage driving means until the first and second time intervals corresponding, respectively, to the first and second holding time data set in the timer means lapse.

5. A printing device according to claim 4, wherein said control means further comprises a second memory means for storing energization time data, corresponding to said input character code, as energy data and said control unit means supplies said energization time data read out of said second memory means to said printing hammer driving means for driving said printing hammer over a time period corresponding to the energization time data.

6. A printing device according to claim 1, wherein the respective time data stored in said memory means contains first, second and third holding time data respectively indicating first, second and third time intervals in which the third time interval is set shorter than the first time interval and longer than the second time interval, and said control means comprises timer means and a control unit means for setting in said timer means said first, second and third holding time data read out of said memory means in accordance with said input character code, for supplying said energy data to said printing hammer driving means to cause said printing hammer to be driven while at the same time starting said timer means, and for preventing the operation of said printing wheel driving means, said carriage driving means and said printing ribbon driver until the first, second and third time intervals corresponding, respectively, to the first, second and third holding time data set in the timer means lapse.

7. A printing device according to claim 6, wherein said control means further comprises a second memory means for storing energization time data, corresponding to said input character code, as energy data and said control unit means supplies said energization time data read out of said second memory means to said printing hammer driving means and drives said printing hammer over a time period corresponding to the energization time data.

* * * * *